US008146274B2

(12) United States Patent
Verstraelen et al.

(10) Patent No.: US 8,146,274 B2
(45) Date of Patent: Apr. 3, 2012

(54) METHOD AND SYSTEM FOR OPTIMIZING DREDGING

(75) Inventors: Luk Verstraelen, Vossem (BE); Lucien Halleux, Spa (BE)

(73) Assignee: Dredging International N.V., Zwijndrecht (BE)

( * ) Notice: Subject to any disclaimer, the term of this patent is extended or adjusted under 35 U.S.C. 154(b) by 0 days.

(21) Appl. No.: 12/677,858

(22) PCT Filed: Sep. 11, 2008

(86) PCT No.: PCT/EP2008/062055

§ 371 (c)(1),
(2), (4) Date: Mar. 12, 2010

(87) PCT Pub. No.: WO2009/034128

PCT Pub. Date: Mar. 19, 2009

(65) Prior Publication Data

US 2010/0299971 A1 Dec. 2, 2010

(30) Foreign Application Priority Data

Sep. 13, 2007 (EP) ..... 07116286

(51) Int. Cl.
*E02F 3/88* (2006.01)

(52) U.S. Cl. ..... 37/317

(58) Field of Classification Search ..... 37/317–323, 37/257–262, 307, 308, 326–337; 299/8, 299/9

See application file for complete search history.

(56) References Cited

U.S. PATENT DOCUMENTS

| | | | | |
|---|---|---|---|---|
| 3,645,018 | A | 2/1972 | Koning et al. | |
| 3,811,730 | A * | 5/1974 | Dane, Jr. | 299/8 |
| 4,020,573 | A * | 5/1977 | Wegewijs et al. | 37/308 |
| 4,345,388 | A | 8/1982 | De Keizer | |
| 4,955,437 | A | 9/1990 | Bohman | |
| 5,428,908 | A * | 7/1995 | Kerfoot | 37/323 |
| 7,631,445 | B2 * | 12/2009 | Harrell | 37/348 |
| 2002/0063652 | A1 | 5/2002 | Price | |
| 2003/0009286 | A1 | 1/2003 | Shibusawa et al. | |
| 2004/0168358 | A1 | 9/2004 | Stump | |
| 2006/0090379 | A1 | 5/2006 | Furem | |

FOREIGN PATENT DOCUMENTS

| | | |
|---|---|---|
| GB | 2048990 | 12/1980 |
| WO | WO 2004/106643 | 12/2004 |
| WO | WO 2005/103396 | 11/2005 |

* cited by examiner

*Primary Examiner* — Robert Pezzuto

(74) *Attorney, Agent, or Firm* — Novak Druce + Quigg LLP

(57) ABSTRACT

The present invention relates to a method for optimizing the dredging of an area by a dredge equipped with a cutter suction head (4) comprising the steps of: obtaining conventional soil information of the area to be dredged; measuring local soil parameters in and around the position of the cutter head during dredging; calculating dredging parameters for a current and subsequent cutter head position based on the combination of conventional and local soil parameters to optimize yield and cutter wear; and adjusting the dredging parameters so giving optimum efficiency at a current and subsequent cutter head position. It also relates to a system that implements the method.

12 Claims, 1 Drawing Sheet

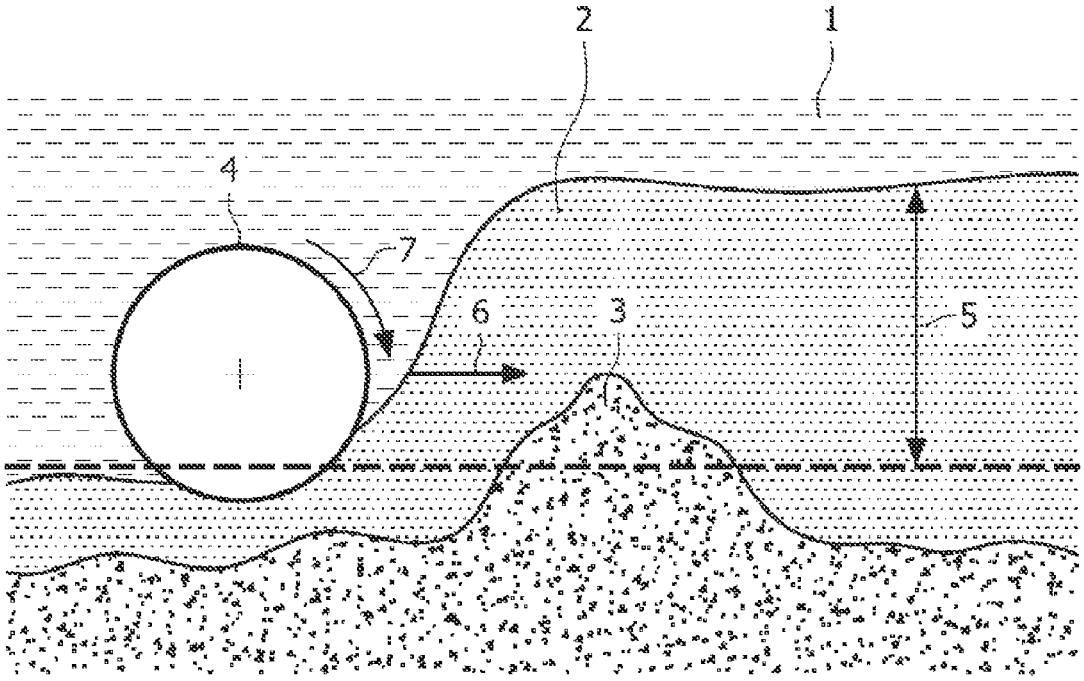
2
1
4
7
6
3
5

METHOD AND SYSTEM FOR OPTIMIZING DREDGING

CROSS-REFERENCE TO RELATED APPLICATIONS

This application is a §371 national stage entry of International Application No. PCT/EP2008/062055, filed Sep. 11, 2008, which claims priority to European Patent Application No. 07116286.1, filed Sep. 13, 2007, both of which are hereby incorporated by reference.

BACKGROUND

The last ten years have seen an important increase in the volume of dredging activity, of which an increasing proportion is performed on solid rock. This situation is explained by the increased depth required by marine infrastructure projects and by the geological characteristics of certain regions such as the Persian Gulf. All projections indicate that this tendency of growth will continue in the next decade.

In response to this evolution, dredgers with increasingly powerful cutter heads are operating in construction areas; allowing a higher production rate at a lower cost compared to the traditional drilling and blasting method.

The optimal exploitation of a dredge implies a good geological knowledge of the site. In particular, the position of the rock zones most resistant to cutting must be known because they should be attacked prudently to avoid undue wear and damage to the cutter.

However, in reality, the quality and depth of the rock frequently varies abruptly both in the vertical and horizontal directions. Thus, the cutter head 4 (FIG. 1), can encounter a few meters of loose ground (sand) 2 followed by a rock 3 more resistant than concrete. In most cases, a document of invitation to tender will give an indication on the geological and geotechnical situ characteristics but it is often insufficient and incomplete. The area of dredging sites is typically a few square kilometers and the distance between exploratory boreholes is typically several hundred meters, whereas shallow rock zones often measure about ten meters only. Such hard spots frequently remain undetected until hit by the cutter head. The simple drilling of additional random boreholes, does not improve the situation.

Traditionally, the dredge master is faced with two possible options:

- trying to use "brute force" to maximize the production output, with a high risk of rupture and thus of frequent stops for unplanned repair;
- avoiding damage to the cutter suction dredge by limiting the cutting power, which involves an unnecessarily low production output in the non-rock zones.

The present invention aims to overcome the problems in the art by providing a system that provides specific adjustment to the cutting parameters based on high resolution information on the material close to the cutter head in addition to the low resolution information usually already available. The high resolution information is acquired and updated while dredging. The objective is to fine tune an existing geological model close by the cutter head, during the dredging process itself via geo-physical measurements close around and in front of the cutter head.

FIGURE LEGEND

FIG. 1 Schematic illustration of a cross-section of the seabed, showing water layer 1, sand layer 2, rock layer 3, cutter head 4, and depth of dredging under seabed 5. The cutter head 4 rotates 7, and advances 6 into the sand 2 and/or rock 3 layers.

SUMMARY OF THE INVENTION

One embodiment of the invention is a method for optimizing, during dredging, the dredging of an area by a dredge equipped with a cutter suction head comprising the steps of:

- obtaining conventional soil information of the area to be dredged,
- measuring local soil parameters in and around the position of the cutter head during dredging,
- calculating dredging parameters for a current and subsequent cutter head position based on the combination of conventional and local soil parameters to optimize yield and cutter wear,
- adjusting the dredging parameters so giving optimum efficiency at a current and subsequent cutter head position.

Another embodiment of the invention is a method as defined above, wherein the local soil parameters comprises seismic data.

Another embodiment of the invention is a method as defined above, wherein said seismic data comprises seismic reflection and/or seismic refraction data and/or seismic surface wave data Another embodiment of the invention is a method as defined above, wherein local soil parameters comprises geo-resistivity data.

Another embodiment of the invention is a method as defined above, wherein local soil parameters comprises parametric echosounding data.

Another embodiment of the invention is a method as defined above, wherein the local soil parameters comprises any of vibrational data, sound data, temperature measurements at the cutter head, swing speed of the cutter head.

Another embodiment of the invention is a method as defined above, wherein the cutter parameters are any of lateral swing speed, cutter head rotation speed, cutter head rotation torque, attacked layer thickness and width per cut.

Another embodiment of the invention is a method as defined above, wherein the geological survey data is obtained from drilling, boreholes, vibrocores, piston sampling, cone penetration testing, and wash probing.

Another embodiment of the invention is a method as defined above, wherein a layer thickness and/or layer width attacked and/or the lateral swing speed of the cutter are reduced when the proximity of harder soil or rock is measured or expected.

Another embodiment of the invention is a method as defined above, wherein a layer thickness and/or layer width attacked and/or the lateral swing speed of the cutter are increased when the proximity of softer soil is measured or expected.

Another embodiment of the invention is a system for optimizing the dredging of an area by a dredge equipped with a cutter head, comprising:

- a means to receive conventional soil data of the area to be dredged,
- a means to measure local soil parameters in the locality of the cutter head during dredging,
- a means to optimize dredging parameters for a current and subsequent cutter head position based on the combination of conventional and local soil information to optimize yield and cutter wear, a means to output dredging parameters, thereby adjusting the dredging parameters so giving optimum efficiency at a current and subsequent cutter head position.

Another embodiment of the invention is a system as described above, having the features defined in the method above.

DETAILED DESCRIPTION OF THE INVENTION

Unless defined otherwise, all technical and scientific terms used herein have the same meaning as is commonly understood by one of skill in the art. All publications referenced herein are incorporated by reference thereto. All United States patents and patent applications referenced herein are incorporated by reference herein in their entirety including the drawings.

The articles "a" and "an" are used herein to refer to one or to more than one, i.e. to at least one of the grammatical object of the article. By way of example, "a sensor" means one sensor or more than one sensor.

Throughout this application, the term "about" is used to indicate that a value includes the standard deviation of error for the device or method being employed to determine the value.

The recitation of numerical ranges by endpoints includes all integer numbers and, where appropriate, fractions subsumed within that range (e.g. 1 to 5 can include 1, 2, 3, 4 when referring to, for example, a number of samples, and can also include 1.5, 2, 2.75 and 3.80, when referring to, for example, concentrations). The recitation of end points also includes the end point values themselves (e.g. from 1.0 to 5.0 includes both 1.0 and 5.0).

The present invention is related to the finding by the inventors that it is possible to measure while dredging soil or rock, parameters which give indications on the underwater excavability, hereafter called dredgeability. One or more of these parameters are used in combination with the conventional soil data to adjust cutter parameters at the cutting site and at a subsequent cutting location. Parameters which can be adjusted are for example the cutter rotation speed, the pulling force on the winches or any other parameter adjusted in order to optimize yield and/or to reduce wear and tear.

One aspect of the invention relates to a method for optimizing, during dredging, the dredging of an area by a dredge equipped with a cutter suction head, comprising:

obtaining conventional soil data of the area to be dredged, measuring soil parameters in and around the locality of the cutter head during dredging, calculating dredge parameters for a current and a subsequent cutter head position based on the combination of geological survey data and local soil parameters acquired while dredging to optimize yield and cutter wear, and adjusting cutter parameters in order to optimize production output at a current and subsequent cutter head position.

Conventional soil data designates all information obtained about the soil or rock properties by using conventional sources or investigation methods independently of the dredging operations; examples are: geological data from maps and publications, borehole descriptions, geotechnical testing reports, geophysical surveys, etc.

Local soil parameters are those parameters measured in the vicinity of the current position of the cutter head.

The soil parameters are measured using any in situ technique (e.g. seismic refraction survey, seismic reflection survey, geo-resistivity survey, parametric echosounding survey, etc. . . . ) most preferably a measurement of seismic velocity (P wave and/or S wave velocity) which has been found to give particularly good results. Seismic velocity designates the velocity of propagation of a seismic wave in the ground. Either compressive seismic waves (P waves) or shear seismic waves (S waves) may be used. The corresponding seismic velocities are designated as P wave velocity and S wave velocity.

The seismic velocity is a measured soil parameter relating to the geotechnical characteristics of a rock or soil mass, and is preferably measured via a seismic refraction survey. In addition to or instead of the seismic velocity, other soil parameters may be measured as well using one or more other geophysical techniques, e.g. geo-resistivity survey, seismic reflection survey, seismic surface waves observations, parametric echosounding survey, etc. . . . .

Secondary soil related parameters can be employed in the analysis to provide more accuracy. These include vibrational data, sound data, temperature measurements at the cutter head and swing speed of the cutter head. It is within the scope of the invention to use the seismic signals generated by the dredging operation itself to study the soil. Generally the measurement in question is acquired by an appropriate sensor. The sensor may be mounted on the dredge itself, laid upon the sea bed or towed behind a suitable auxiliary vessel.

The cutter head is generally a wheel or sphere, mounted on its rotational axis by a ladder suspended below the dredging vessel. The direction of the ladder is adjustable in three-dimensions within its sweep range and can, therefore, cut downwards, forwards and laterally. The dredging parameters that are calculated by the present system can be used to adjust one or more of the cutting characteristics (cutter parameters) of the dredging process e.g. lateral swing speed, cutter head rotation speed, cutter head rotation torque, attacked layer thickness and width per cut. The teeth of the cutter are commonly bi-directional but having a lower cutting action in one lateral swing direction (the so called overcutting swing direction) compared with the other (the so called undercutting swing direction). The lateral swing method can be adjusted to, for example, loosen sand and soft clay in the low-impact overcutting direction, and to cut rock in the high-impact undercutting direction.

The geological survey data may be any obtained by methods generally known to the skilled person. For example, it may be that obtained from geological image atlases, or from site-specific drilling.

The method may provide a soil image, that is made available to the dredge master via a Soil Viewer computer display. Based on this information and in full automatic dredging mode, it is the dredge computer itself that will translate this geological information in optimum dredging parameters for the purpose of maximizing the performance of the dredge in a so called self learning process One aspect of the invention is a system for optimizing, during dredging, the dredging of an area by a dredge equipped with a cutter suction head, comprising:

a means to receive conventional soil data of the area to be dredged, a means to measure local soil parameters in the locality of the cutter head during dredging, a means to optimize dredging parameters for a current and subsequent cutter head position based on the combination of conventional and local soil information to optimize yield and cutter wear, a means to output cutter parameters, thereby adjusting the cutter parameters so giving optimum efficiency at a current and subsequent cutter head position.

The features defined above in respect of the method apply also to the system.

According to one aspect of the invention, the dredging parameters are outputted on a display of a map which shows the current position of the cutter. The map may be provided with levels (e.g. colours, contours lines, . . . ) indicating the optimum cutting parameters. This might be a function of one or more measured geophysical parameters during the cutting process. From the display, and in manual dredge mode, the Dredge Master can determine the most appropriate cutter parameters to optimize the dredging. As the cutter head approaches a harder zone, (e.g. high seismic speed and/or high resistivity), the Dredge Master can reduce the pulling force on the sidewinch, and thus the lateral swing speed in order to approach the hard spots carefully. As soon as the hard zone is passed, the pulling force is increased, and thus the lateral swing speed, in order to return to a maximum production output. In automatic dredge mode, the cutter computer itself on board of the cutter suction dredge will translate the gathered geological information into optimum dredging parameters. The invention is not limited to the use of seismic velocity or geo-resistivity or any other parameters or a combination of parameters, as may be justified for a particular dredging project.

The present invention advantageously provides a means to determine the optimum dredging regime with reliance on survey maps or boreholes which have too low resolution to allow fine control and optimal wear and yield parameters. The use of geo-physical data in particular has been found to increase yield and efficiency; currently the profit of aggregate output on building site is estimated at 10%. The system allows a fine and fast geological survey of the soil which data can be used to build maps.

EXAMPLE 1

Determining Techniques for Measuring Soil Parameters

For optimizing the exploitation of the dredge, it was necessary to optimize the methodology of obtaining soil parameters. Non-destructive geophysics are the principal techniques that allow coverage of several square kilometers quickly and for reasonable costs. Initially, an inventory of the applicable geophysics methods at sea was established; some are used everyday for non-dredging marine surveying, but do not give a directly exploitable mechanical characteristic. Others provide useful parameters, but were used little at sea. Particularly useful were:

- high resolution marine seismic reflection survey,
- marine geo-resistivity survey,
- marine seismic refraction survey,
- marine seismic surface waves The seismic reflection is a traditional method at sea. It makes it possible to obtain a good sub-seabed image, but lacks information relating to the mechanical properties of the soil.

The seismic velocity, obtained by seismic refraction, provides information regarding the mechanical properties of the soil. The seismic refraction equipment was modified to allow an effective marine implementation, while keeping a total weight limited in order to allow a fast packing and the use on light boats.

The correct exploitation of the seismic refraction and of the geo-resistivity required a short study in order to define the significance of the measured parameters. The electrical resistivity, measured by geo-resistivity, was found to provide complementary information on the mechanical properties of the soil compared to the information obtained via the seismic velocity.

RESULTS OBTAINED

The feedback analysis showed a correlation between the measured soil parameters and the production output. These correlations also depend on the type of rock considered and on the dredge. The combination of site specific conventional soil information with the results of the local measurements provide as such the best information.

The resulting information is made available to the Dredge Master in real time allowing him to adjust the dredge parameters according to the resistance of the rock that will be encountered. This tool makes it possible to maintain a good production rate in the less resistant zones while reducing the consecutive time of repair due to ruptures and wear in the harder rocks. The experience feedback from the heavy duty cutter suction dredge d'Artagnan indicates that the crew is very positive of this type of tool. Currently, the profit of aggregate output on building site is estimated at 10%.

The invention claimed is:

1. A method for optimizing, during dredging, the dredging of an area by a cutter dredge equipped with a cutter suction head comprising the steps of:

- obtaining conventional soil information of the area to be dredged,
- measuring local soil parameters in and around the position of the cutter suction head during dredging,
- calculating dredging parameters for a current cutter suction head position and subsequent cutter suction head position based on the combination of conventional soil information and local soil parameters to optimize yield and cutter wear, and
- using the calculated dredging parameters to adjust cutter dredge parameters such that an optimum efficiency at the current cutter suction head position and the subsequent cutter suction head position is obtained.

2. A method according to claim 1, wherein the local soil parameters comprise seismic data.

3. A method according to claim 2, wherein said seismic data comprises at least one of seismic reflection data, seismic refraction data, and seismic surface wave data.

4. A method according to claim 1, wherein the local soil parameters comprise geo-resistivity data.

5. A method according to claim 1, wherein the local soil parameters comprise parametric echosounding data.

6. A method according to claim 1, wherein the local soil parameters comprise any of vibrational data, sound data, temperature measurements at the cutter head, and swing speed of the cutter head.

7. A method according to claim 1, wherein the dredging parameters comprise any of lateral swing speed, cutter suction head rotation speed, cutter suction head rotation torque, attacked layer thickness and width per cut.

8. A method according to claim 1, wherein the conventional soil information comprises geological survey data obtained from at least one of drilling, boreholes, vibrocores, piston sampling, cone penetration testing, and wash probing.

9. A method according to claim 1 wherein at least one of a layer thickness, layer width attacked, and lateral swing speed of the cutter dredge are reduced when the proximity of harder soil or rock is expected.

10. A method according to claim 1 wherein at least one of a layer thickness, layer width attacked and lateral swing speed of the cutter dredge are increased when the proximity of softer soil is expected.

11. A system for optimizing the dredging of an area by a cutter dredge equipped with a cutter suction head, comprising:

a means to receive conventional soil data of the area to be dredged, a means to measure local soil parameters in the locality of the cutter suction head during dredging, a means to optimize dredging parameters for a current cutter head position and a subsequent cutter head position based on the combination of conventional and local soil information to optimize yield and cutter drudge wear, a means to output dredging parameters, thereby adjusting cutter dredge parameters used on the dredging parameters such that an optimum efficiency at current cutter head position and the subsequent cutter head position.

12. A system according to claim 11, further comprising a means for carrying out the steps of:

obtaining conventional soil information of the area to be dredged, measuring local soil parameters in and around the position of the cutter suction head during dredging, calculating dredging parameters for a current cutter suction head position and a subsequent cutter suction head position based on the combination of conventional and local soil parameters to optimize yield and cutter dredge wear, and using the calculated dredging parameters to adjust cutter dredge parameters such that an optimum efficiency at the current cutter suction head position and the subsequent cutter suction head position is obtained, wherein the local soil parameters comprise seismic data.

* * * * *